US006400269B1

(12) United States Patent
Savastano

(10) Patent No.: US 6,400,269 B1
(45) **Date of Patent: *Jun. 4, 2002**

(54) FIREARM ALARM

(76) Inventor: Anthony Savastano, 505 N. Link Rd., Alpharetta, GA (US) 30022

( * ) Notice: Subject to any disclaimer, the term of this patent is extended or adjusted under 35 U.S.C. 154(b) by 0 days.

This patent is subject to a terminal disclaimer.

(21) Appl. No.: 09/588,430

(22) Filed: Jun. 6, 2000

Related U.S. Application Data

(63) Continuation-in-part of application No. 09/453,359, filed on Dec. 1, 1999.

(51) Int. Cl.[7] ..... G08B 13/14

(52) U.S. Cl. ..... 340/568.1; 340/539; 340/506; 340/571; 340/572; 340/573; 340/693

(58) Field of Search ..... 340/539, 568.1, 340/573, 571, 693, 506, 572

(56) References Cited

U.S. PATENT DOCUMENTS

| | | | | | |
|---|---|---|---|---|---|
| 3,604,958 | A | | 9/1971 | Palini | 340/280 |
| 3,637,180 | A | | 1/1972 | Parry | 248/203 |
| 3,767,093 | A | | 10/1973 | Pinkerton et al. | 224/1 R |
| 3,857,491 | A | | 12/1974 | Townsend et al. | 211/8 |
| 4,150,371 | A | | 4/1979 | Scaglione | 340/568 |
| 4,155,608 | A | | 5/1979 | Orlewicz | 312/204 |
| 4,267,553 | A | | 5/1981 | Vogelsanger et al. | 340/571 |
| 4,274,088 | A | | 6/1981 | Pierson et al. | 340/568 |
| 4,274,282 | A | | 6/1981 | Budraitis et al. | 340/665 |
| 4,303,908 | A | | 12/1981 | Enemark et al. | 340/384 E |
| 4,378,476 | A | | 3/1983 | Nicholas | 200/85 R |
| 4,457,091 | A | | 7/1984 | Wallerstein | 42/1 LP |
| 4,624,372 | A | | 11/1986 | Brolin | 211/4 |
| 4,716,401 | A | | 12/1987 | Wohlford et al. | 340/568 |
| 4,761,005 | A | | 8/1988 | French et al. | 273/1 GC |
| 4,768,021 | A | | 8/1988 | Ferraro | 340/568 |
| 4,768,375 | A | | 9/1988 | Eckardt et al. | 340/58 |
| 4,788,838 | A | | 12/1988 | Cislo | 70/63 |
| 4,890,466 | A | | 1/1990 | Cislo | 70/63 |
| 5,196,827 | A | | 3/1993 | Allen et al. | 340/568 |
| 5,236,086 | A | * | 8/1993 | MacTaggart | 206/317 |
| 5,313,733 | A | * | 5/1994 | Meade | 42/70.11 |
| 5,511,711 | A | | 4/1996 | Kunz | 224/539 |
| 5,525,966 | A | * | 6/1996 | Parish | 340/568 |
| 5,720,193 | A | * | 2/1998 | Dick | 70/298 |
| 5,768,819 | A | * | 6/1998 | Neal | 42/96 |
| 5,828,301 | A | * | 10/1998 | Sanchez | 340/539 |

* cited by examiner

*Primary Examiner*—Jeffery Hofsass
*Assistant Examiner*—Hung Nguyen
(74) *Attorney, Agent, or Firm*—Handal & Morofsky

(57) ABSTRACT

A device for safely storing or displaying a firearm that alerts its owner if the device or firearm are disturbed by unauthorized individuals and also provides its owner with quick access to the firearm when necessary. The device comprises a covered support member with a recessed volume generally configured to fit at least a portion of a firearm, actuators that activate an alarm if the device is uncovered or the firearm is removed without authorization, and a concealed de-activator.

10 Claims, 6 Drawing Sheets

Figure 1
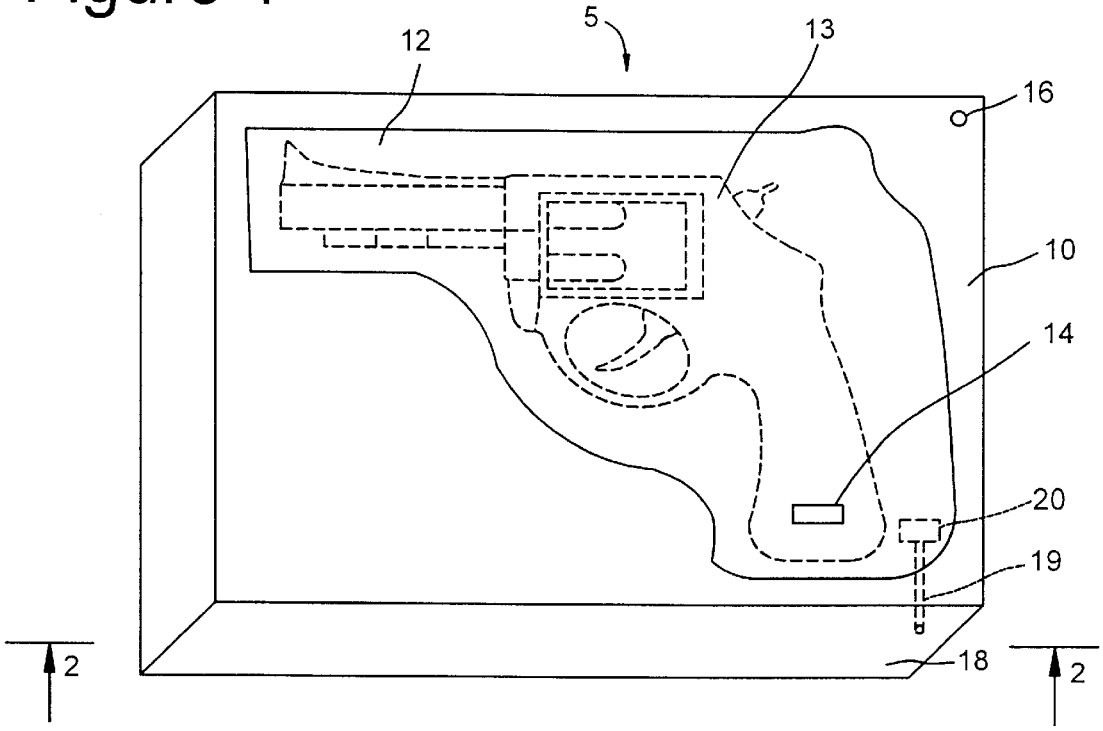
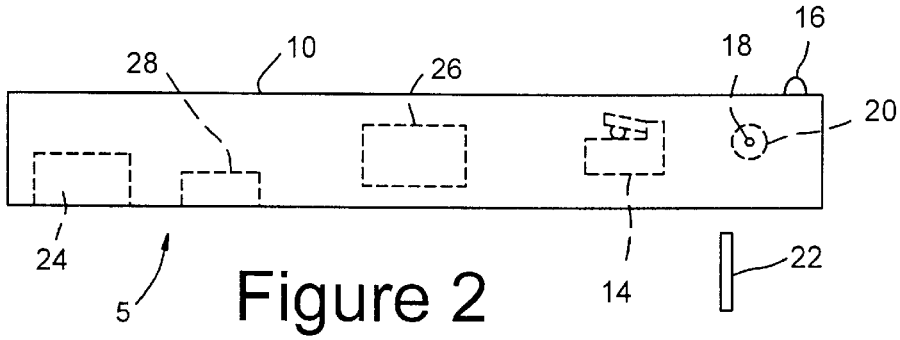
Figure 2
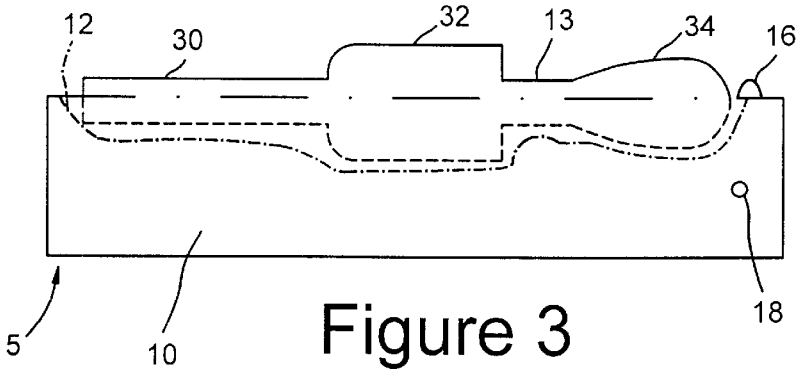
Figure 3

FIREARM ALARM

CROSS-REFERENCE TO RELATED APPLICATIONS

This application is a continuation-in-part of co-pending U.S. patent application Ser. No. 09/453,359 filed Dec. 1, 1999. The disclosure of the aforementioned U.S. patent application is hereby incorporated herein by reference thereto.

STATEMENT REGARDING FEDERALLY SPONSORED RESEARCH OR DEVELOPMENT (Not applicable.)

BACKGROUND OF THE INVENTION

1. Field of the Invention

The present invention relates to a firearm storage device with an alarm that prevents the unauthorized removal of the firearm while allowing the owner quick access to the firearm.

2. Description of Related Art Including Information Disclosed under 37 CFR 1.97 and 37 CFR 1.98.

As recent national headlines bear witness, American society pays a high price for poorly secured guns. Representatives of religious, civic, government, law enforcement and community organizations throughout the U.S. have stood up publicly to press for passage of gun-control laws in an effort to keep guns out of the hands of those not legally permitted to carry them, including new penalties on gun owners responsible for leaving guns accessible to children who use them to commit violent acts.

On Nov. 1, 1999, CNN reported that a study conducted by the American Academy of Pediatrics found that many parents who own guns keep them loaded or unlocked at home and substantially underestimate the risk of injury to their children. Researchers determined that an alarming number of families keep both pistols and rifles where young family members could find them. Furthermore, the majority of those studied kept at least one of these firearms, usually a handgun, either unlocked or loaded, and a significant proportion of them kept them both unlocked and loaded. Last year 500 children died and 25,000 were injured in what doctors called "preventable" accidents.

Furthermore, the American Academy of Child and Adolescent Psychiatry provides some alarming statistics. Every day, 10 American children ages 18 and under are killed in handgun suicide, homicides and accidents, and many more are wounded. An estimated 400,000 youngsters carried handguns to school in 1987. Since at least 25 million American households keep handguns and 50% of all owners keep them loaded, it is highly likely that a youngster with a firearm obtained it from their own home without being detected by their parents.

Children and adolescents are inherently playful, active, curious and impulsive. Such healthy traits when mixed with guns can cause death. The proximity of juveniles notwithstanding, the undeniable danger associated with gun possession should concern all gun owners and compel them to secure their firearms. Furthermore, gun owners may be held legally liable for the consequences of their failure to institute protective measures.

Firearms are typically stored in locked cabinets or cases for safety purposes. However, collectors and dealers have a need to display their firearms in an openly viewable and appealing manner, such as on a stand. This presents a dilemma for collectors and dealers who wish to display their firearms, especially handguns, at exhibitions or trade shows in a less restrictive manner. They are typically restricted to either using a locked enclosure or displaying the handgun relatively unsecured. The former method is inconvenient and burdensome. The latter method is convenient but unsafe.

Alternatively, quick access is required where a firearm, especially a handgun, is kept for protective purposes. If a locked case is used to store the gun, time may be lost in unlocking the case and removing the gun, which could negate the protective advantage of possessing a firearm in the first place. In all situations where firearms are stored, it is desirable to provide an alarm to indicate that the gun has been moved by an unauthorized person or a child.

Furthermore, ease of operation is of great significance, since a device that provides adequate security and accessibility at the price of excessive inconvenience discourages people from using it. The dangerous consequences of an unauthorized use of a firearm necessitates that any device designed to provide for its accessibility and security be simple to engage.

U.S. Pat. No. 4,155,608 issued to Orlewicz discloses a wall-mountable gun cabinet having a hinged door, the face of which is disguised as a decorative wall article. A lockable inner door provides some additional measure of security.

U.S. Pat. No. 4,768,021 issued to Ferraro discloses a case or safe with an electronic lock having a touch pad on which a code must be entered to gain access to the gun. An alarm sounds if the safe is removed from the surface on which it is mounted.

U.S. Pat. No. 4,788,838 issued to Cislo discloses a lockbox for handguns that is lockably attached to a bedframe. Access is gained by entering a code with a touchpad provided on the box.

U.S. Pat. No. 5,196,827 issued to Allen, et al. discloses a handgun display device having a flat upper plate for placing a handgun on and a lower base plate with force sensors embedded in between. Two variable resistors must be adjusted to set an upper and lower force threshold, and an alarm is triggered when the upper and lower force thresholds are breached.

U.S. Pat. No. 4,274,088 issued to Pierson discloses a portable alarm system for use in museums having spring-loaded plungers protruding out from two regions of a flat base member. The bottom plunger is depressed by the stand or table on which the base sits and the top plunger is depressed by the art work placed upon it. The two plungers are connected to switches that activate a tamper alarm if either plunger extends to full protrusion when the alarm is armed.

Despite these and other related attempts at balancing firearm security and accessibility, there remains a need for a complete, reliable and simple resolution to the problems of the inconvenient gun access and insecure open gun display. Furthermore, these and other related devices present no adequate solution to the problem of securely displaying or storing a gun in a reliable and uncomplicated device, while allowing it to be accessed easily and quickly by authorized persons. In many situations where guns are displayed, high-security enclosures are unnecessary. A security device that functions independently and allows the owner the option of adding additional security measures, when circumstances require such, is highly desirable. These unresolved problems and deficiencies are clearly felt in the art and are solved by present invention in the manner described below.

BRIEF SUMMARY OF THE INVENTION

The present invention solves the problem of creating a convenient and uncomplicated device for securing against the unauthorized removal of a firearm without limiting the accessibility of the firearm to its owner. It is also well-suited for protecting the firearm while on display, or in combination with any suitable enclosure, such as a locked case, drawer, or box.

The invention comprises a support member having a recessed volume, molded and contoured to the general shape of a firearm, and an alarm that activates if the firearm is removed from the recessed volume. The alarm may be initialized by an attached or remote actuator. In preferred embodiments, the alarm is initiated by placing the firearm on an actuator located in the recessed volume itself. The alarm may be audible or made to send a signal to a remote location or device, such as a pager, telephone, or alert a home security force.

In preferred embodiments, an indicator lamp illuminates if the alarm is activated and remains lit until a de-activator is triggered. The alarm may be cut short and reset by way of an electronic timer, to alert the owner to any unauthorized removal of the gun. In preferred embodiments, the de-activator for the alarm and indicator lamp, which is preferably the device reset/on-off switch, is concealed.

The de-activator may be concealed in many ways, inside or outside the support member. In alternative embodiments, the de-activator may be triggered by remote transmitter. The purpose in concealing the switch is to require special knowledge of its whereabouts and a special tool to gain access it. This can be accomplished in a variety of uncomplicated yet extremely effective ways. The de-activator switch may be concealed at the end of a thin tube extending within the support member, thus restricting its access to pin-like objects only. Alternatively, the entryway to the switch can be shaped to limit its accessibility to a specially-shaped key. Preferably, the de-activator switch comprises a reed switch which is concealed within the support member. The switch is actuated when a magnet is placed in close proximity.

Using the recessed volume helps make the device less likely to cause false alarms, and the generic mold can accommodate a wide variety of firearms. The recessed volume conforms to the general shape of a gun, that is, the recessed volume can be deep or shallow, curved or angular, depending on the width and shape of the part of the gun that would normally rest there. For example, if the device was to be used for handguns with revolving barrels, the recessed volume would be deepest at the point where the barrel would rest, shallow at the shaft, and somewhere in between for the handgrip. Since most firearms of the same type or caliber have the same basic shape, a generic recessed volume would satisfactorily accommodate most firearms of a particular type or caliber. For instance, a recessed volume molded for revolvers should accommodate most revolvers while a recessed volume molded for semi-automatic handguns should accommodate most semi-automatic handguns. However, other embodiments of the inventive device include recessed volumes molded to fit only a portion of the gun, or having a recessed volume molded to suit the characteristics of a particular make or model of gun. In addition, the recessed volume may accommodate more than one firearm.

The invention also provides a gun owner with quick access to the firearm. This is highly important if the firearm is to be kept in the home for protective purposes. An alternate embodiment of the inventive device provides even greater accessibility. In this embodiment, an aperture is added to the recessed volume that would allow the gun owner to quickly slip his or her hand around the handgrip of the handgun to enable the owner to bring the handgun to a ready position quicker in case of an emergency. In this capacity, the gun owner may want to deactivate the device while at home, and then activate it upon leaving the premises.

An alternative embodiment of the inventive device comprises a recessed volume molded to fit the entire gun excluding the handgrip, thus leaving the handgrip exposed for even quicker access. In this embodiment, the actuator could be manually triggered or located in the recessed area where the barrel of the gun would rest. Optimizing the location of components and mold of the recessed area, for purposes such as gaining quicker access to the firearm, is contemplated as being within the scope of the invention.

The device may be battery-powered, in which case a low battery indicator light may be added to the support member. The support member may be made from plastic or metal, while the recessed area may also be plastic or metal but may be covered with a felt, rubber or fabric.

An alternative embodiment of the present invention includes a covering for the device. The cover may be made of plastic, or other suitable material, and partially attached, hinged or completely removable from the device. Preferably, the inventive device further comprises an opaque cover that conceals the identity of the contents of the inventive device, and a switch set to trigger the alarm or other alert when the cover is opened. The switch may be a magnetic switch but preferably, the switch is a proximity switch, such as a reed switch and magnet combination. When the cover is removed without deactivating the device, the magnet and reed switch are separated and the reed switch's contacts close, which triggers the alarm. The cover and support member can also be made so that the cover fits in a groove or snap-fits onto the support member.

This system serves to further discourage unauthorized use of a firearm prior to any physical disturbance of the firearm itself, and in particular, to further discourage a child from picking up the firearm. The alarm may be initialized by closing the cover and deactivated by a remote or attached actuator, or by any other means as discussed herein and known to those skilled in the art as being in accordance with the present invention.

BRIEF DESCRIPTION OF THE SEVERAL VIEWS OF THE DRAWING

One or more embodiments of the invention and of making and using the invention, as well as the best mode contemplated of carrying out the invention, are described in detail below, by way of example, with reference to the accompanying drawings, in which:

FIG. 1 is a perspective view of a first embodiment of the present invention;

FIG. 2 is a side view taken along line 2—2 of the embodiment illustrated in FIG. 1;

FIG. 3 is a side view taken along line 2—2 of the embodiment illustrated in FIG. 1 with a handgun in the recessed volume;

DETAILED DESCRIPTION OF THE INVENTION

Figure 4:
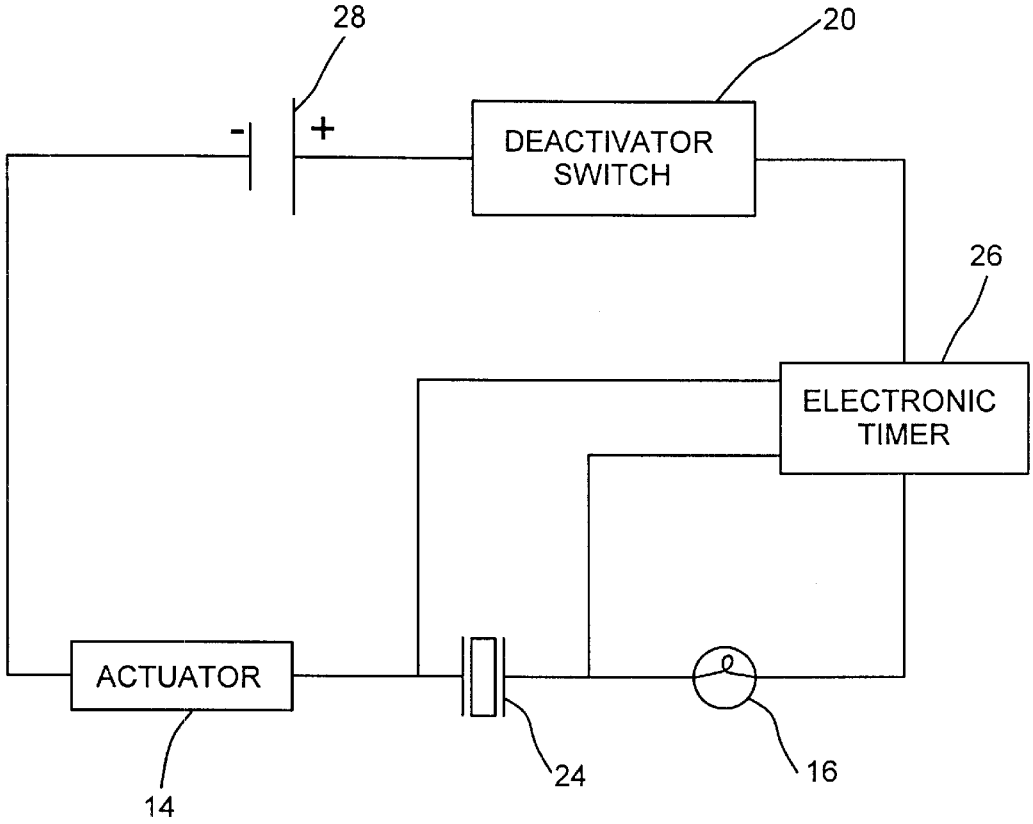
FIG. 4 is a block diagram of the first embodiment.

The following more detailed description of the invention is intended to be read in the light of, or in context with, the preceding summary and background descriptions. Unless otherwise apparent, or stated, directional references, such as "up", "down", "left", "right", "front" and "rear", are intended to be relative to the orientation of a particular embodiment of the invention as shown in the first numbered view of that embodiment.

Although the present invention is not limited to handguns, but extensible to many other firearms, handguns are utilized in practicing the invention in the illustrated embodiments. The embodiments of the inventive device which accommodate handguns depicted and described herein are also used as a convenient vehicle for illustrating aspects, features, and characteristics of the invention.

FIGS. 1–4 depict a first embodiment of the inventive device 5. Support member 10 comprises recessed volume 12 molded in the general size and shape of a handgun. An actuator or alarm trigger switch 14 is disposed in recessed volume 12 at a location that will contact the handgrip of firearm 13 placed in recessed volume 12. Actuator 14 is depressed when firearm 13 is placed in the recessed volume 12, which sets alarm 24. Alarm 24 does not activate unless actuator 14 is released, which occurs if firearm 13 is removed from recessed volume 12. Also, indicator lamp 16 illuminates to signal that firearm 13 has been removed and remains lit until device 5 is reset, via concealed de-activator switch 20, located in support member 10, accessible through opening 18. Firearm 13 rests in recessed volume 12. Recessed volume 12, as shown by the dotted-dashed line in FIG. 3, accommodates gun barrel 32, gun shaft 30 and handgrip 34 by being shaped to correspond to the shape of firearm 13.

Opening 18 is actually the exterior end of a thin hollow tube 19 which extends from support member 10. The de-activator switch 20 is at the interior end of tube 19. The diameter and length of tube 19 is such that the de-activator switch 20 can only be triggered by inserting pin 22, or an object of similar size and shape into opening 18. When the system is activated and firearm 13 is removed from its resting position, actuator switch 14 is released, sounding audible alarm 24 and illuminating indicator lamp 16 on support member 10.

Electronic timer 26 in support member 10 will keep alarm 24 ringing for a predetermined period of time after which alarm 24 shuts off and resets, even if firearm 13 is quickly put back in its resting position in recessed volume 12, thus depressing actuator switch 14 once again. Alarm 24 may be set to make periodic short bursts of sound after the full alarm sound has been stopped by electronic timer 26, until device 5 has been completely deactivated by switch 20. Also, indicator lamp 16 stays lit as evidence that firearm 13 was removed from recessed volume 12 until de-activator switch 20 is triggered. Device 5 is powered by battery 28 located in support member 10.

Figure 5:
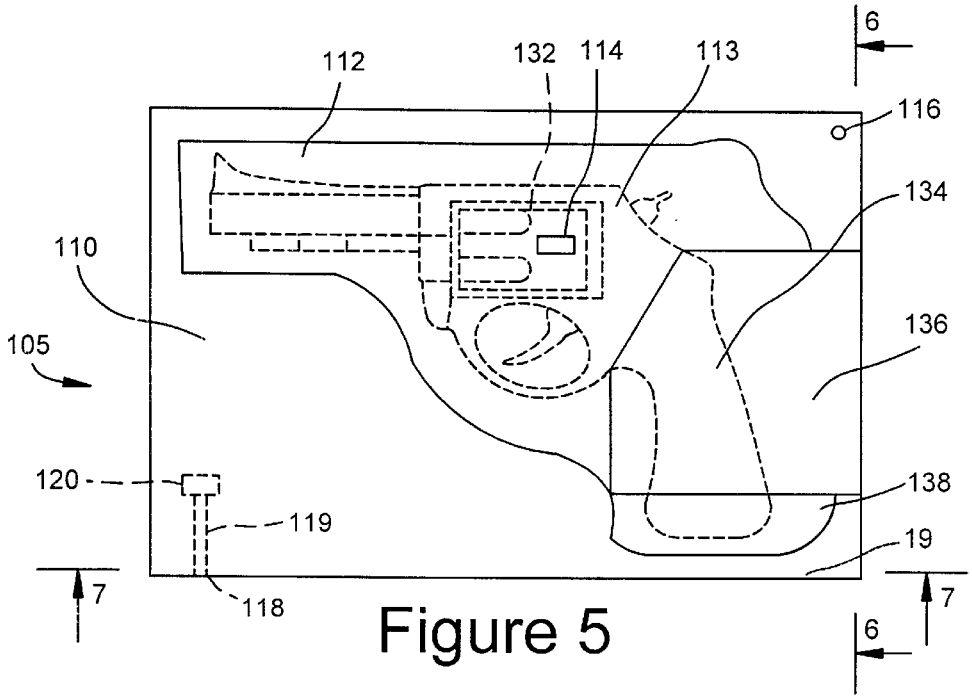
FIG. 5 is a top view of an alternative embodiment of the inventive device.
Figure 6:
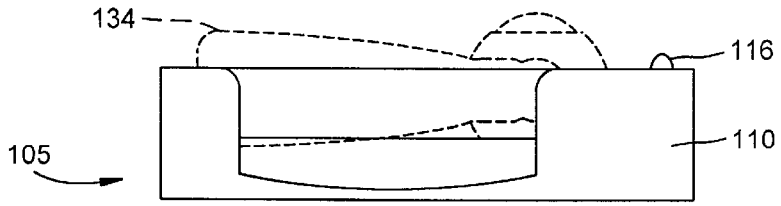
FIG. 6 is a side view taken along line 6—6 of the alternative embodiment of the inventive device illustrated in FIG. 5.
Figure 7:
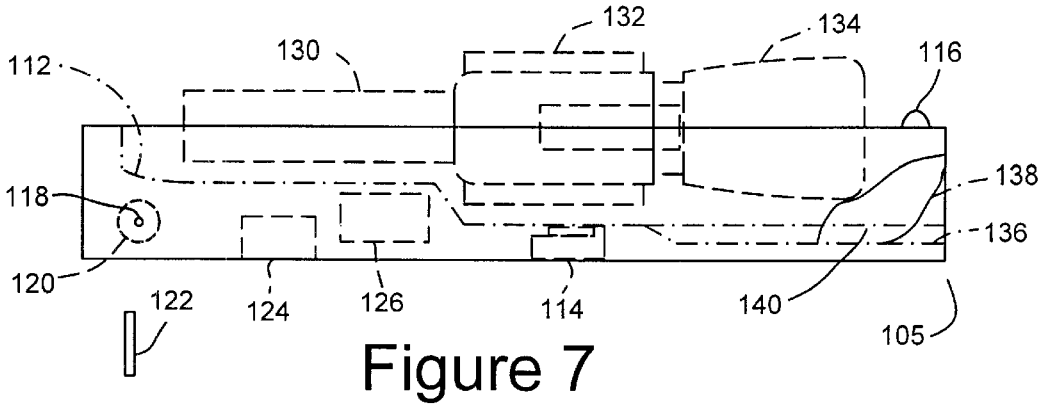
FIG. 7 is a side view taken along line 7—7 of the alternative embodiment of the inventive device illustrated in FIG. 5.
Figure 8:
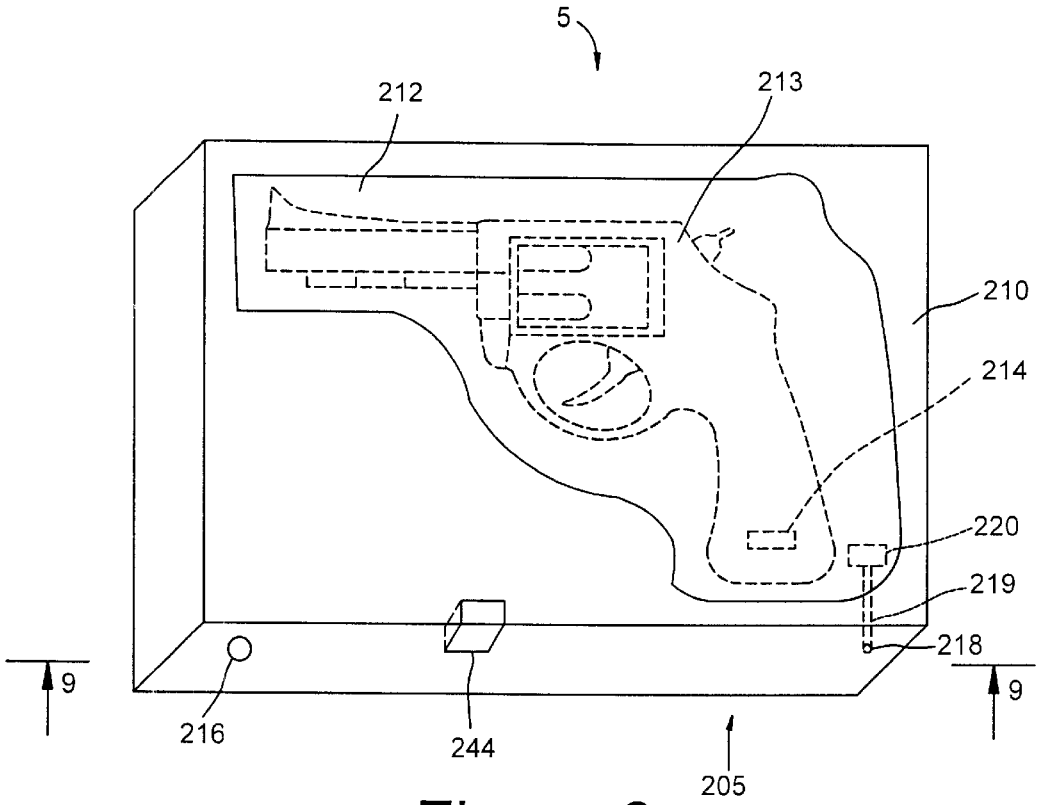
FIG. 8 is a perspective view of a third embodiment of the inventive device.
Figure 9:
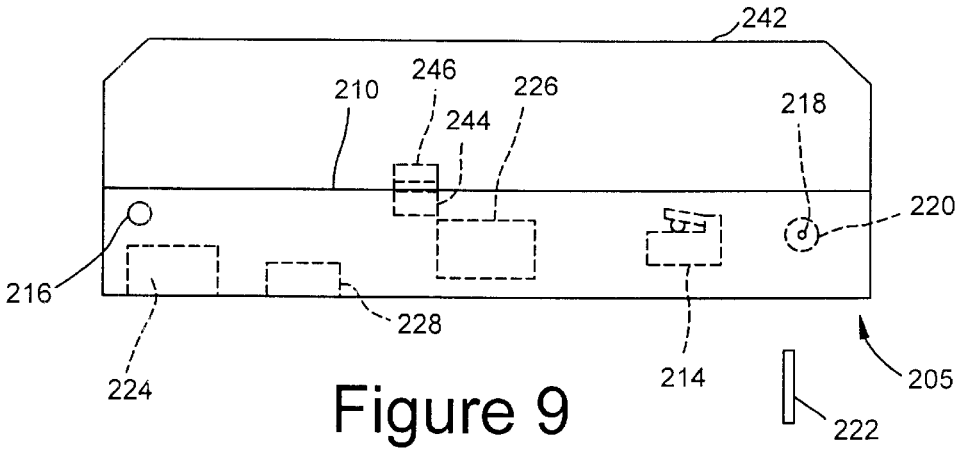
FIG. 9 is a side view taken along line 9—9 of the embodiment illustrated in FIG. 8.
Figure 10:
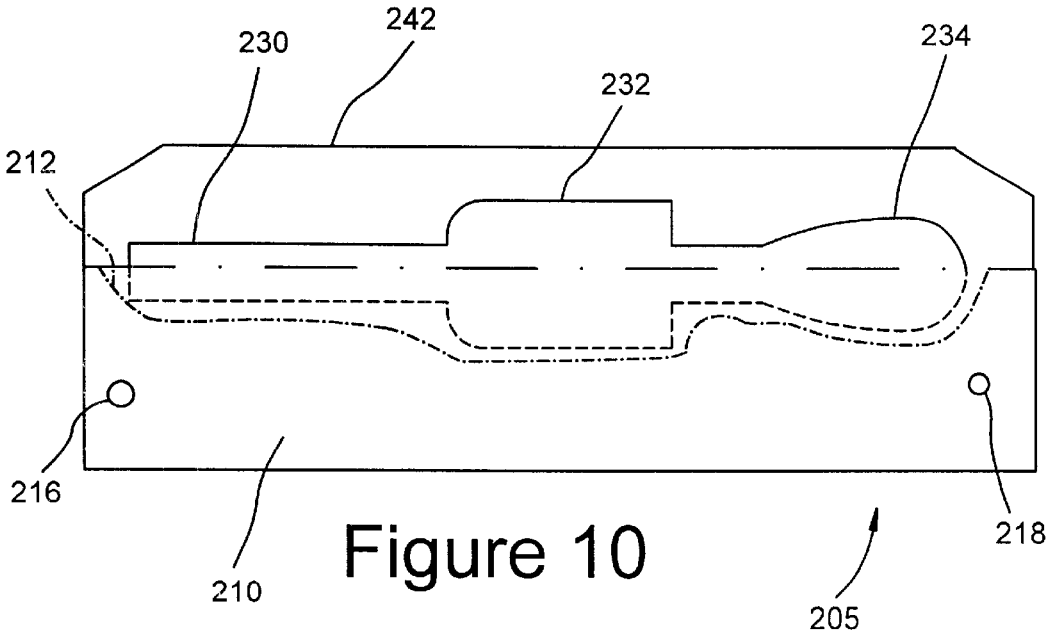
FIG. 10 is a side view taken along line 9—9 of the embodiment illustrated in FIG. 8 with its cover and a handgun depicted in the recessed volume.

FIGS. 5–7 depict an alternative embodiment of the present invention. Inventive device 105 features aperture 136, which provides the gun owner with even quicker access to handgrip 134. Aperture 136 extends underneath handgrip 134, thus providing enough space for the gun owner to wrap his or her hand around handgrip 134, and reducing the amount of time to bring firearm 113 to a ready-to-fire position. Aperture 136 does not interfere with the stability of firearm 113 in recessed volume 112 because the remaining portions of recessed volume 112 are molded to fit firearm 113 securely. Furthermore, a portion of handgrip 134 is supported by recessed volume 112 at supporting ledge 138. In this embodiment, actuator 114 is located in recessed volume 112 in the area where barrel 132 rests. Opening 118 and de-activator switch 120 are disposed in support member 110. FIGS. 8–10 depict a third embodiment of the present invention. A support member 210 comprises recessed volume 212 molded in the general size and shape of a handgun. An actuator or alarm trigger switch 214 is disposed in recessed volume 212 at a location that will contact the handgrip of firearm 213 placed in recessed volume 212. Actuator 214 is depressed when firearm 213 is placed in the recessed volume 212, which sets alarm 224.

Support member 210 further comprises cover 242. Actuator 244 is a magnetic switch which closes in the presence of a magnetic field when cover 242 which comprises magnet 246 is placed on device 205. Cover 242 rests on top of the support member 210 and in doing so, magnet 246 aligns with actuator 244 setting alarm 224. Thereafter, removal of cover 242 breaks the magnetic seal which triggers alarm 224. Indicator lamp 216 illuminates to signal that the alarm has activated and remains lit until device 205 is reset, via concealed de-activator switch 220, located in support member 210, accessible through opening 218.

Cover 242 is generally configured to fit at least a portion of support member 210, preferably covering the entire recessed volume 212. Magnetic switch 244 also further secures device 205 and prevents cover 242 from being accidentally removed. Additional magnets on cover 242 and support member 210 may also be implemented in accordance with this invention.

In this embodiment, actuator 244 and actuator 214 are connected to alarm 224 in parallel so that either actuator 244 or actuator 214 can initiate the same alarm 224. However, a separately connected alarm of the same or different type for each actuator is contemplated in accordance with this invention. For example, the alarms can be modified as discussed herein, so that unauthorized removal of the cover transmits a signal to a remote paging device, and unauthorized removal of the firearm underneath triggers an audible alarm.

As illustrated by the dotted-dashed line in FIG. 10, recessed volume 212 accommodates gun barrel 232, gun shaft 230 and handgrip 234 by being molded in a manner that corresponds to the shape of firearm 213.

Figure 11:
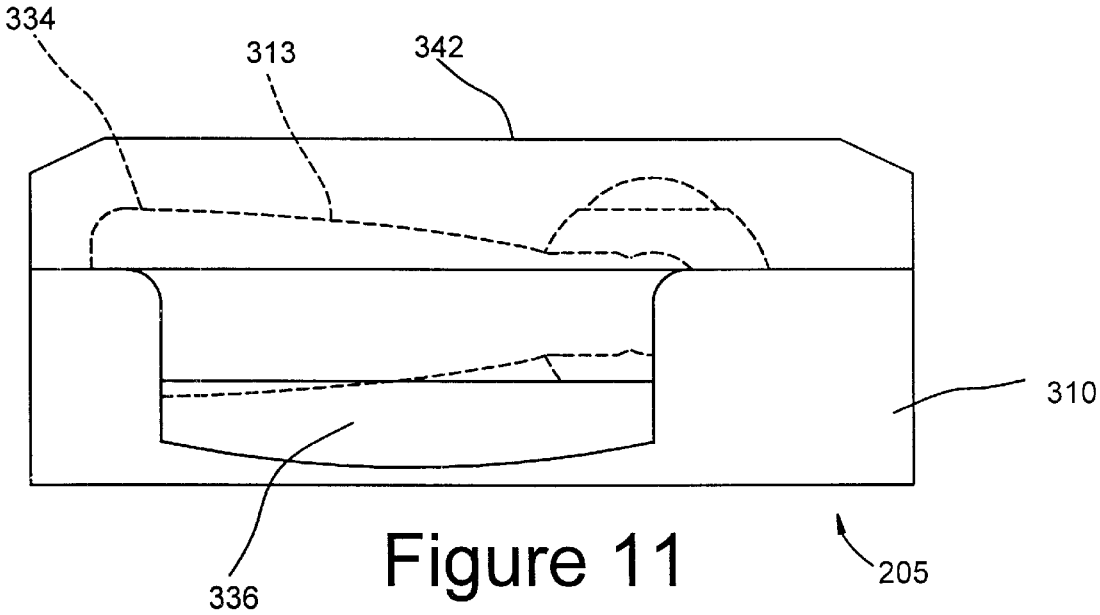
FIG. 11 is a side view of a fourth alternative embodiment of the inventive device with its cover.

FIG. 11 depicts a fourth alternative embodiment having aperture 336 which provides access to handgrip 334, beneath cover 342, and through the side of support member 310. Aperture 336 provides quick access to the firearm while maintaining a high level of security for firearm 313, among other things.

Figure 12:
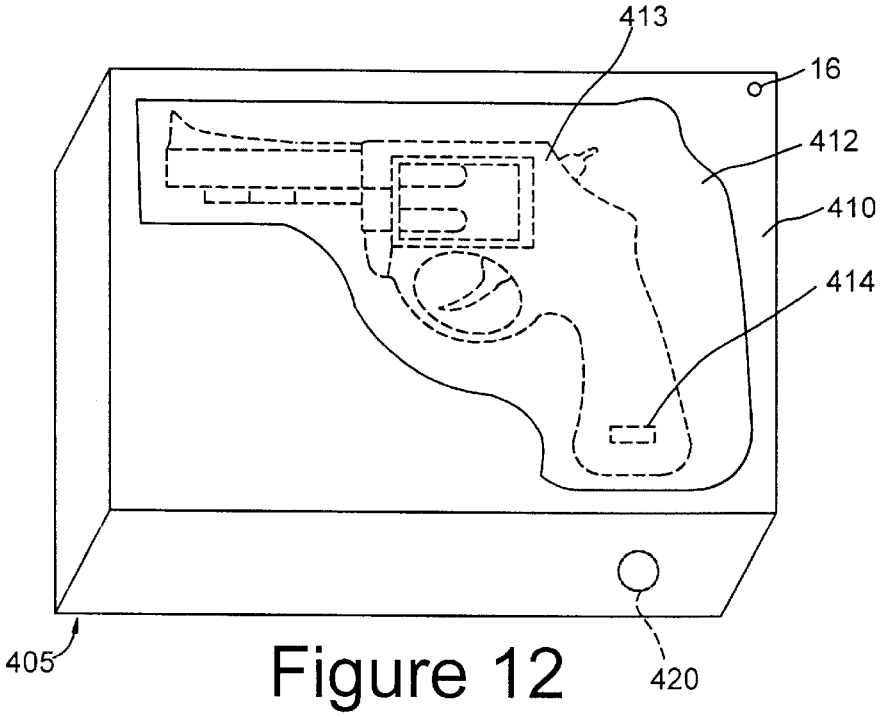
FIG. 12 is a perspective view of a fifth alternative embodiment of the inventive device.
Figure 13:
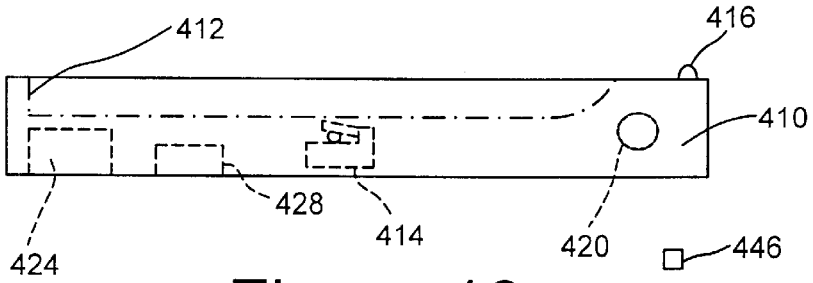
FIG. 13 is a side view of a fifth alternative embodiment of the inventive device.
Figure 14:
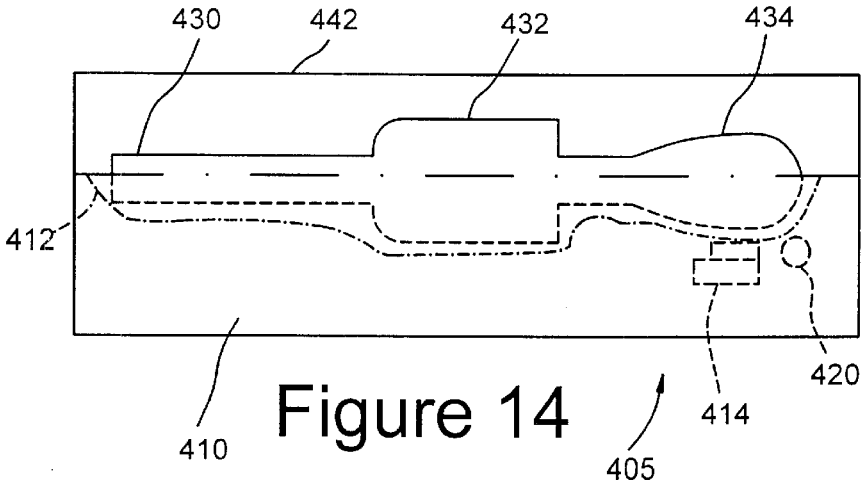
FIG. 14 is a side view of a fifth alternative embodiment of the inventive device with its cover.

FIGS. 12–14 depict a fifth alternative embodiment in which actuator 414 is contacted by recessed volume 412 when firearm 413 is placed in recessed volume 412. In this embodiment, actuator 414 is disposed under recessed volume 412 which is capable of contacting actuator 414 within support member 410. Preferably, the entire recessed volume 412 is capable of vertical movement within support member 410, although moving only a portion of recessed volume 412 is necessary for contacting actuator 414. When not supporting firearm 413, recessed volume 412 maintains an idle position that does not depress actuator 414. Actuator 414 is depressed by the downward positional variation of recessed volume 412, which is caused by the added weight of firearm 413 in recessed volume 412. Actuator 414 is released and alarm 424 sounds when the weight of firearm 413 is removed from recessed volume 412, thus returning recessed volume 412 to its idle position. Recessed volume 412 may be made of a springy foam or lightweight material, or a separated from support member 410 and supported by any conventional means that allows movement to contact actuator 414 in the manner described above. The operating force of actuator 414 is small enough to be actuated by lighter firearms and large enough to avoid causing false alarms. The operating force of actuator 414 may also be sufficient to push recessed volume 412 upward when firearm 413 is removed. Preferably, the operating force is approximately 200 grams.

De-activator 420 comprises a reed switch which is concealed within support member 410. De-activator 420 is triggered by the presence of a magnetic field within a close proximity. Therefore, deactivating the system or disengaging alarm 424 may be accomplished by placing magnet 446 against the outer surface of support member 410 at a location directly opposing de-activator 420. Magnet 446 and support member 410 may also include fasteners or a corresponding fastening means, such as Velcro strips, so that magnet 446 may be kept on the outer surface of support member 410, at the proper location to keep device 405 deactivated, until activation of device 405 is desired. Removal of magnet 446 from its position thereafter activates the system.

While illustrative embodiments of the invention have been described above, it is, of course, understood that various modifications will be apparent to those of ordinary skill in the art. Many such modifications are contemplated as being within the spirit and scope of the invention.

What is claimed is:

1. A device for storing or displaying a firearm, comprising:

(a) a support member;

(b) a recessed volume defined in said support member, said recessed volume being generally configured to fit at least a portion of a firearm, wherein the firearm is freely removable from said recessed volume;

(c) a control device;

(d) a cover generally configured to fit over at least a portion of said support member;

(e) an actuator for sensing the removal of a firearm from said recessed volume and activating said control device in response to the removal of the firearm from said recessed volume;

(f) an alarm in communication with said control device and responsive to said actuator for signaling unauthorized removal of the firearm from said recessed volume;

(g) a de-activator in communication with said control device for resetting the alarm; and (h) a second actuator located proximate to the position where said cover rests on the support member, whereby said second actuator activates said control means in response to the removal of said cover from its resting position.

2. A device as in claim 1, further comprising a second alarm linked to said control means and responsive only to said second actuator.

3. A device as in claim 1, further comprising a timer linked to said control means and responsive to said first and second actuators, said timer resetting the alarm after a predetermined period of time of alarm activation.

4. A device as in claim 1, further comprising an indicator lamp linked to said control means and responsive to said first and second actuators, said indicator lamp illuminating after alarm activation and capable of being reset by said de-activator.

5. A device as in claim 1, wherein said second actuator is a magnetic switch and said cover further comprises at least one magnet, whereby at least one of said magnets contact the second actuator when said cover is placed in its resting position on the support member.

6. A device for storing or displaying a firearm, comprising:

(a) a support member;

(b) a recessed volume defined in said support member, said recessed volume being generally configured to fit at least a portion of a firearm wherein the firearm is freely removable from said recessed volume;

(c) a control device;

(d) a cover generally configured to fit over at least a portion of said support member, said cover and said support member further comprise more than one magnet disposed on each whereby the ends of said magnets having opposing polarity contact each other when the cover rests on the support member;

(e) an actuator for sensing the removal of a firearm from said recessed volume and activating said control device in response to the removal of the firearm from said recessed volume;

(f) an alarm in communication with said control device and responsive to said actuator for signaling unauthorized removal of the firearm from said recessed volume; and (g) a de-activator in communication with said control device for resetting the alarm.

7. A device for storing or displaying a firearm, comprising:

(a) a support member;

(b) a recessed volume defined in said support member, said recessed volume being generally configured to fit at least a portion of a firearm wherein the firearm is freely removable from said recessed volume, said recessed volume further comprising a movable portion responsive to the placement in or removal of said firearm from said recessed volume;

(c) a cover generally configured to fit over at least a portion of said support member;

(d) a control circuit;

(e) an actuator for sensing the removal the firearm from said recessed volume, said actuator being located in said support member and engaged by said movable portion when the firearm is placed in the recessed volume, whereby said control circuit is activated, said movable portion disengaging with said actuator in response to the removal of the handgun from the recessed volume;

(f) an audible alarm linked to said control circuit and responsive to said actuator;

(g) a timer linked to said control circuit and responsive to said actuator, said timer resetting the alarm after a predetermined period of time of alarm activation;

(h) an indicator lamp linked to said control circuit and responsive to said actuator, said indicator lamp illuminating after alarm activation;

(i) a de-activator linked to said control circuit for resetting the alarm and the indicator lamp, said de-activator being concealed within the support member; and (j) a second actuator located proximate to the position where said cover rests, said second actuator being linked to said control circuit and said alarm being responsive to said second actuator, whereby said second actuator is set when the cover is placed in its resting position on the support member and activates said control circuit in response to the removal of said cover from the resting position.

8. A device as in claim 7, wherein said second actuator is a magnetic switch and said cover further comprises at least one magnet, whereby at least one of said magnets contact the second actuator when said cover is placed in its resting position on the support member.

9. A device for storing or displaying a firearm, comprising:

(a) a support member;

(b) a recessed volume defined in said support member, said recessed volume being generally configured to fit at least a portion of a firearm, said firearm being freely removable from said recessed volume, said recessed volume further comprising a movable portion responsive to the placement in or removal of said firearm from said recessed volume;

(c) a cover generally configured to fit over at least a portion of said support member;

(d) a control circuit;

(e) an actuator for sensing the removal the firearm from said recessed volume, said actuator being located in said support member and engaged by said movable portion when the firearm is placed in the recessed volume, whereby said control circuit is activated, said movable portion disengaging with said actuator in response to the removal of the handgun from the recessed volume;

(f) an audible alarm linked to said control circuit and responsive to said actuator;

(g) a timer linked to said control circuit and responsive to said actuator, said timer resetting the alarm after a predetermined period of time of alarm activation;

(h) an indicator lamp linked to said control circuit and responsive to said actuator, said indicator lamp illuminating after alarm activation; and (i) a de-activator linked to said control circuit for resetting the alarm and said indicator lamp, said de-activator being concealed within the support member wherein said de-activator comprises a reed switch.

10. A device for storing or displaying a firearm, comprising:

(a) a support member;

(b) a recessed volume defined in said support member, said recessed volume being generally configured to fit at least a portion of a firearm, wherein the firearm is freely removable from said recessed volume;

(c) a control device;

(d) a covering being positioned on said support member and configured and dimensioned to cover said recessed volume;

(e) an actuator in said support member being initiated by placement of said covering in position, said actuator sensing the removal of said covering from position and activating said control device in response to the removal of said covering from position;

(f) an alarm in communication with said control device;

(g) a de-activator in communication with said control device for resetting the alarm; and (h) a second actuator for sensing the removal of a firearm from said recessed volume and activating said control device in response to the removal of the firearm from said recessed volume.

* * * * *